US006760984B1

(12) United States Patent
Mishina et al.

(10) Patent No.: US 6,760,984 B1
(45) Date of Patent: Jul. 13, 2004

(54) ROLL FINISHING METHOD AND ROLL FINISHING MACHINE

(75) Inventors: Kenjiro Mishina, Yamato (JP); Kazuhiro Nishiwaki, Yamanashi (JP); Junichi Sugimoto, Yamanashi (JP); Takuji Arita, Yamanashi (JP)

(73) Assignee: Tokyo Sensen Kikai Seinsaskusho, Co., Ltd., Tokyo (JP)

( * ) Notice: Subject to any disclaimer, the term of this patent is extended or adjusted under 35 U.S.C. 154(b) by 201 days.

(21) Appl. No.: 10/009,207

(22) PCT Filed: Jun. 30, 2000

(86) PCT No.: PCT/JP00/04325

§ 371 (c)(1),
(2), (4) Date: Dec. 7, 2001

(87) PCT Pub. No.: WO02/02858

PCT Pub. Date: Jan. 10, 2002

(51) Int. Cl.[7] ..... D06F 67/06
(52) U.S. Cl. ..... 38/67
(58) Field of Search ..... 38/44, 49, 50, 38/54, 55, 64, 67, 68; 222/3; 137/14

(56) References Cited

U.S. PATENT DOCUMENTS 1,555,236 A * 9/1925 Asher ..... 38/67
1,911,617 A * 5/1933 Hamilton, Sr. ..... 38/63
1,968,233 A 7/1934 Troy
2,352,220 A * 6/1944 Overton ..... 34/392
4,414,765 A * 11/1983 Kreinberg et al. ..... 38/54

FOREIGN PATENT DOCUMENTS

| | | | |
|---|---|---|---|
| DE | 3128517 | A1 | 1/1983 |
| DE | 44 41 446 | A1 | 5/1996 |
| JP | 62-157206 | | 10/1987 |
| JP | 10-314499 | A | 12/1998 |
| JP | 292313 | B2 | 4/1999 |
| WO | WO 96/16221 | | 5/1996 |

* cited by examiner

*Primary Examiner*—Ismael Izaguirre
(74) *Attorney, Agent, or Firm*—Nixon Peabody LLP; Jeffrey L. Costellia

(57) ABSTRACT

When a cloth article being treated is sandwiched between a main roll 1 and a heating bed 1*a* and sent in the direction indicated by arrow L is sucked onto a suction roll 15*a* about which a guide belt 15*d* has been wound, the transfer of the cloth article being treated to that guide belt 15*d* is aided, and, in particular, the continued turning of the article being treated together with that main roll, in a condition where it is stuck to the surface of the main roll 1 is prevented. In order to attain the object stated above, compressed air is blown as indicated by arrow j from an air jet pipe 21 having nozzle holes bored therein. The article being treated blown by the compressed air flow is blown away from the main roll 1, sucked over to the suction roll 15*a* as indicated by arrow s, transferred to the suction belt 15*d*, and conveyed along as indicated by arrow e.

9 Claims, 9 Drawing Sheets

PRIOR ART

PRIOR ART

PRIOR ART

PRIOR ART

PRIOR ART

PRIOR ART

ROLL FINISHING METHOD AND ROLL FINISHING MACHINE

TECHNICAL FIELD

This invention relates to a roll finisher for press-finishing already-washed cloth articles (such as sheets, covers, and pillow cases and the like).

BACKGROUND ART

Cloth articles that have been washed in a washing machine are finished by being press-treated by a roll finisher.

A side view of a conventional example of a roll finisher is given in FIG. 4.

Cylindrical main rolls 1, 2, and 3 are deployed horizontally and in parallel, and each rolls turns in the direction indicated by the arrows L.

These main rolls 1, 2, and 3 are configured so as to be hollow, and in some cases are provided with vacuum exhaust means. (By "exhaust," in this invention, is meant to implement vacuum suction and exhaust the inside air, which is a different meaning from that of the exhaust of automobile engines and the like.)

The outer circumferential surfaces of the main rolls 1, 2, and 3 are covered with a felt-form upper wrapping.

These main rolls 1, 2, and 3 are provided with heating beds 1*a*, 2*a*, and 3*a*, respectively, which function as press-finishing irons.

The heating beds 1*a*, 2*a*, and 3*a* noted above are heated by heating steam or heating oil.

Ribbon tape 6 forms endless a loop that is wound about the main rolls 1, 2, and 3 and also about ribbon guides 5. This ribbon tape 6 is made to turn in the direction indicated by the arrow L' at the same speed as the main rolls 1, 2, and 3, while guiding the article being treated 7.

The article being treated 7 is conveyed in by an entrance conveyor 4 and fed between the heating bed 1*a* and the ribbon tape 6. The article being treated 7 is pulled along by the friction between the surface 7*a* on one side thereof and the ribbon tape 6. The surface 7*b* on the other side is pressed against the heating bed 1*a* and made to slide.

The article being treated that has passed between the main roll 1 and the heating bed 1*a* as indicated by the curved arrow L advances between the main roll 2 and the heating bed 2*a*, and then passes between the main roll 3 and the heating bed 3*a*. The press-finished article 7' that has finished passing through is conveyed out from the roll finisher.

FIG. 5 is a front view of the conventional example of roll finisher diagrammed in FIG. 4 as noted above, as seen from the direction of the arrow A. As diagrammed in this figure, a multiplicity of the ribbon tapes 6 and ribbon guides 5 are aligned in the axial direction of the main roll 1. Item 8 is a frame.

In the conventional example of roll finisher described in the foregoing (FIGS. 4 and 5), the ribbon tapes 6 are worn severely, and the durable life thereof is short, which constitutes a difficulty. In addition, the ribbon tapes 6 get sandwiched between the article being treated 7 and the main rolls 1, 2, and 3, and the ribbon tapes 6 leave marks on the surface 7*a* on the one side of the article being treated 7 which adversely affects the finishing quality.

In order to eliminate such difficulties, delivery mechanisms for passing the article being treated along have been devised for taking the article being treated that has passed an upstream main roll and heating bed and supplying it to a downstream main roll and heating bed.

Publicly known delivery mechanisms are now described with reference to the drawings. The basic principle underlying these delivery mechanisms consists of vacuum-adsorbing the article being treated, receiving it on a conveyor belt, and carrying it along.

FIG. 6 is an overall view of a roll finisher equipped with a delivery mechanism that is disclosed in Japanese Patent Application Laid-Open No. H8-107995/1996. The details of the main parts thereof will be described subsequently with reference to FIG. 7.

The article being treated 7 that is fed out from between the upstream main roll 1 and heating bed 1*a* is vacuum-adsorbed and received by a delivery mechanism G.T, and fed in between the downstream main roll 2 and heating bed 2*a*. The finished article 7' fed out from the final main roll 2 and heating bed 2*a* are conveyed out by an exit conveyor 9.

The delivery mechanism G.T noted above comprises a box 11 constituted by porous plates, a ventilating loop-form belt 12 wound about that box, a drive pulley 13 for causing that belt to turn, and an exhaust pipe 10 for vacuum-sucking the air from inside the box 11. The structure of this delivery mechanism G.T is as described below.

FIG. 7 is an enlarged detailed cross-sectional view of the delivery mechanism G.T described above.

The upper half of the box 11 is constituted by a semi-cylindrical porous plate.

The ventilating endless loop belt 12 covers the semi-cylindrical portion noted above, and is wound about four guide pulleys and a drive pulley 13. This drive pulley turns in the direction indicated by the arrow r, and causes the endless loop belt 12 to move orbitally as indicated by the arrows d, d', and d".

The air inside the box 11 is vacuum-sucked by the exhaust pipe 10 as indicated by the arrow c, and the article being treated 7 is sucked onto the ventilating loop belt 12.

Based on the publicly known invention of FIG. 7 and 8 described above, the advantage is gained of marks from the ribbon tapes 6 (FIGS. 4 and 5) not being left on the article being treated. However, the loop belt 12 continually rubs against the box 11, wherefore the durable life of this belt is short.

Japanese Patent Application Laid-Open No. H10-314499/1998 discloses an improved invention wherein wear to the loop belt is prevented and the durable life thereof is extended.

FIG. 8 is a cross-sectional view of the delivery mechanism 15 of that improved invention, that corresponds to FIG. 7 in the publicly known invention described earlier.

Item 15*a* is a suction roll constituted by a porous plate, the air inside of which is vacuum-sucked by an exhaust pipe 15*f* as indicated by the arrow c'. A ventilating guide belt 15*d* is wound about that suction roll 15*a*, a guide roll 15*c*, and a drive pulley 15*h*. Item 15*e* is a tensioning pulley, 15*b* is a guide table, and 15*g* is a guide plate.

The drive pulley 15*h* is made to turn in the direction indicated by the arrow r, causing the loop belt 15*d* to turn as indicated by the arrow e. The suction roll 15*a* also is made to turn in the direction indicated by the arrow r, wherefore there is no danger of early friction between it and the loop belt 15*d*.

FIG. 9 is a schematic cross-sectional view of a roll finisher equipped with the delivery mechanism of the improved invention diagrammed in FIG. 8 as noted in the foregoing. Because the scale is small, the guide plate 15*g* and tensioning pulley 15*e* described in conjunction with FIG. 8 are omitted from the drawing. It is also possible to eliminate the drive pulley 15*h* and drive the rotation of the suction roll 15*a*.

In the improved roll finisher diagrammed in FIG. 9, the article being treated that has passed between the main roll 1 and heating bed 1*a* on the upstream side (the left side in the drawing) is sucked to the suction roll 15*a* by a suction air flow as indicated by the arrow s, placed on the guide belt 15*d*, and carried out as indicated by the arrow e. However, there are cases where that article being treated will keep on going around, together with that main roll 1, as indicated at 7" drawn as a hypothetical line, still sticking to the main roll, without being sucked onto the suction roll 15*a*.

Whether or not this sticking phenomenon happens depends on various parameters, but the main factor in the sticking force here is believed to be the intertwining of the nap of the felt (described earlier) wrapped on the main roll 1 and the nap of the cloth article that is the article being treated.

An object of the present invention, which was devised in view of the circumstances described above, is to provide both a roll finishing method improved so that the article being treated fed out from between the main roll and the heating bed separates from the main roll and is sucked onto the delivery mechanism without fail, and a roll finisher suitable for embodying the method of that invention.

DISCLOSURE OF THE INVENTION

The object of the application of the present invention is a roll finisher comprising main rolls, heating beds, and a delivery mechanism.

The delivery mechanism noted above basically is a delivery mechanism that receives an article being treated from an upstream main roll and heating bed and feeds that to a downstream main roll and heating bed.

However, in terms of applications, it is also possible to apply the present invention to a delivery mechanism for receiving the article being treated from a main roll and a heating bed and sending it to an exit conveyor (also called a discharge conveyor).

With the roll finishing method of the present invention, when the article being treated that has passed between a main roll and a heating bed starts to cross from the main roll to the delivery mechanism, compressed air is blown between the main roll and the article being treated. The striking air flow acts to peel the article being treated away from the main roll. The article being treated peeled away from the main roll is sucked onto the delivery mechanism and carried along.

The roll finisher created for the purpose of embodying the method of the present invention described above comprises air nozzles for jetting compressed air toward the vicinity of the gap between the main roll and the delivery mechanism, and means for sending compressed air to those air nozzles.

BEST MODE FOR CARRYING OUT THE INVENTION

The present invention will now be described in a more detailed manner with reference to FIG. 1 to FIG. 3 in the attached drawings.

Figure 1:
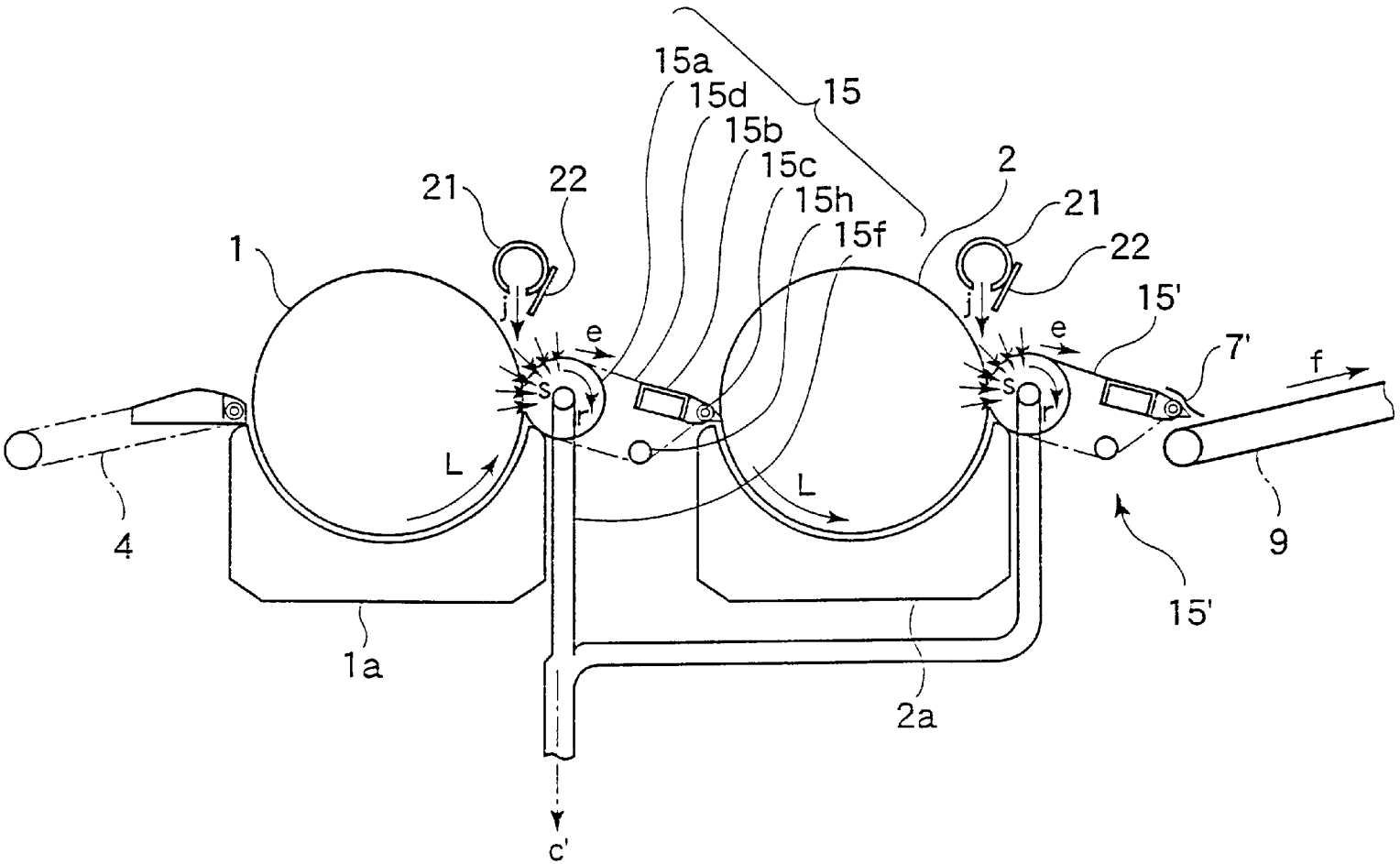
FIG. 1 is a schematic lateral cross-sectional diagram showing one embodiment of a roll finisher relating to the present invention.
Figure 2:
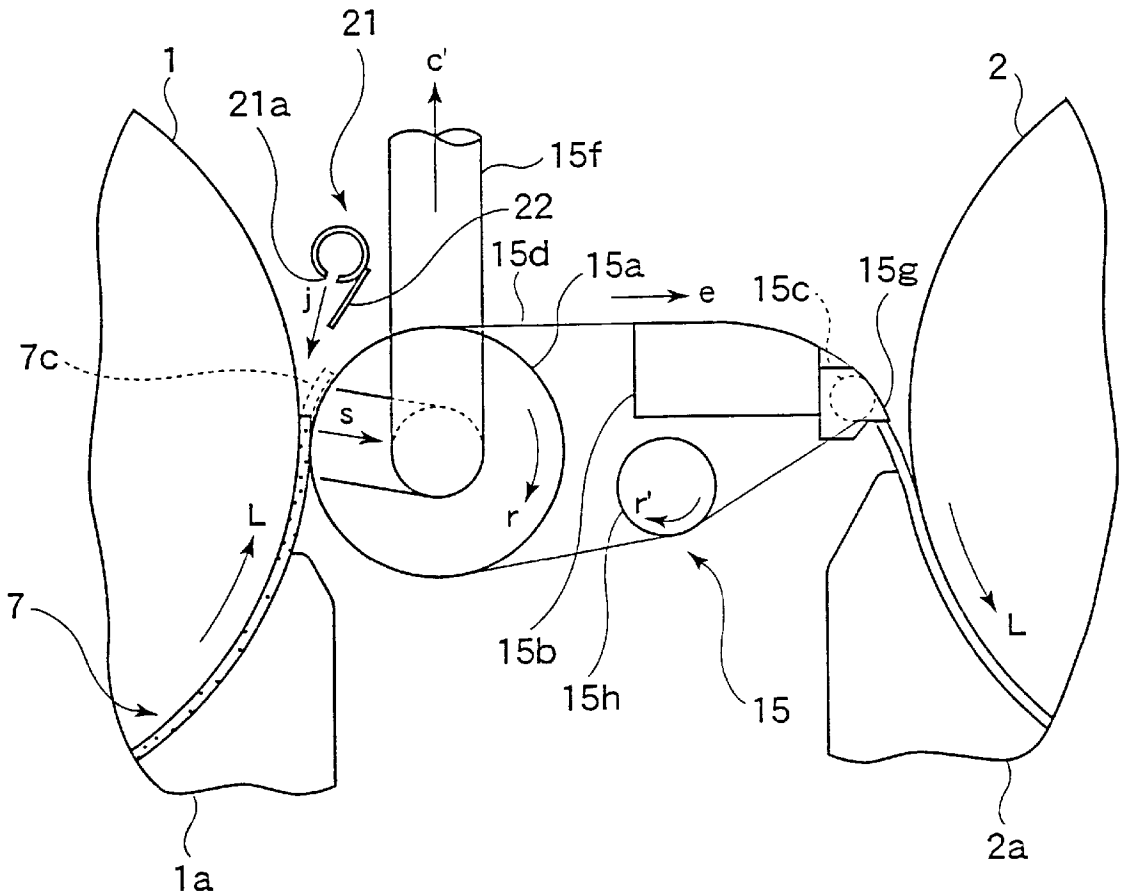
FIG. 2 is a schematic enlarged detailed cross-sectional diagram wherein the main parts of the roll finisher diagrammed in FIG. 1 above are extracted and depicted.
Figure 9:
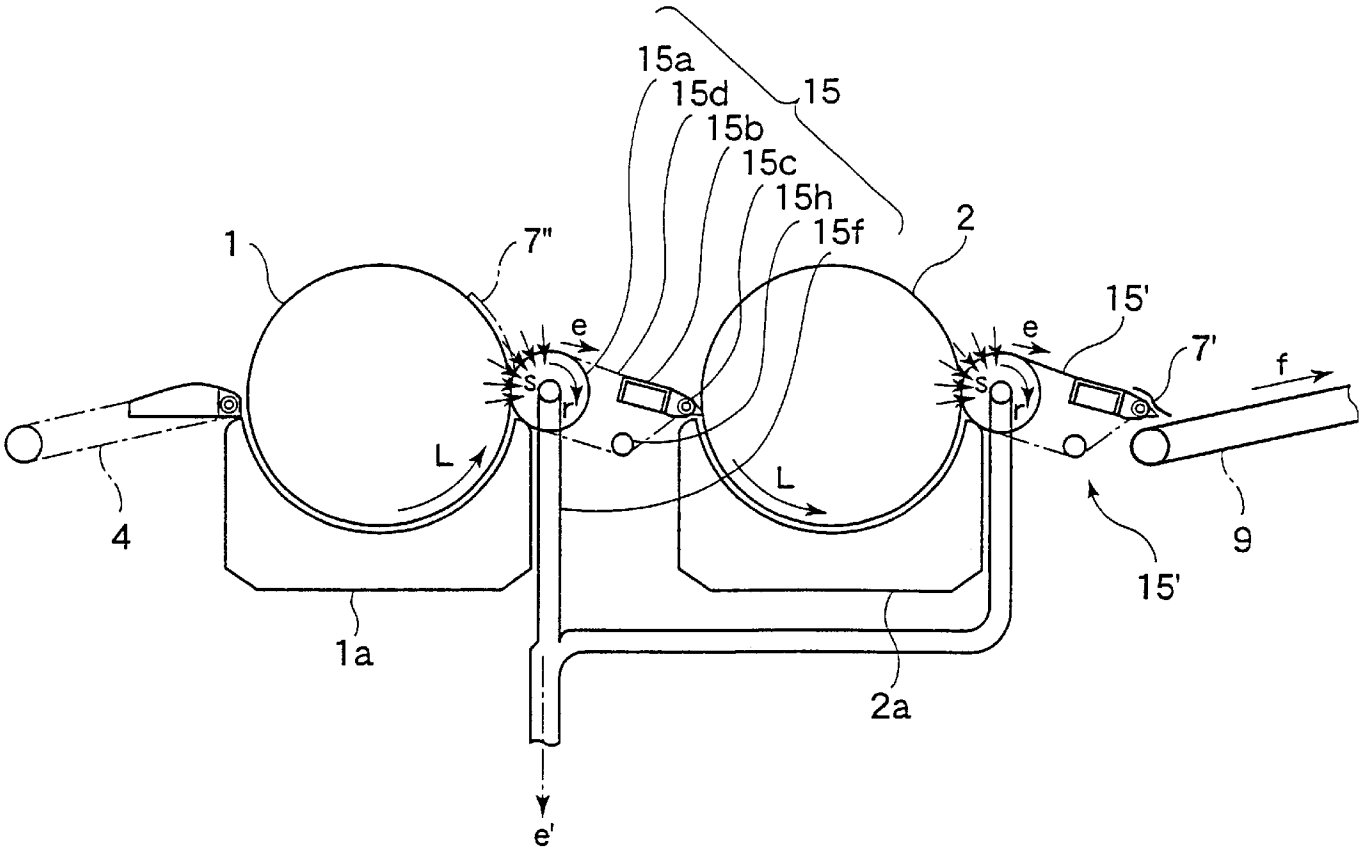
FIG. 9 is a side view for describing technical problems relating to the improved publicly known roll finisher diagrammed in FIG. 8 above.

FIG. 1 represents one embodiment of the present invention. Followings are the points of difference therein as compared to FIG. 9 wherein the improved publicly known example described earlier is depicted, that is, the improved configurational portions wherein the present invention is applied.

Between the main roll 1 and the delivery mechanism 15 is deployed an air jet pipe 21 for blowing compressed air as indicated by the arrow j. The details of the structure of that air jet pipe 21 are described subsequently in detail with reference to FIG. 2.

In order to effectively direct the jetting air flow as indicated by the arrow j, an air guiding plate 22 is deployed.

The air jet -pipe 21 and air guiding plate 22 can also be deployed between the main roll 2 and the heating bed 2*a*, on the one hand, and the delivery mechanism 15', on the other.

In the air jet pipe 21 (see FIG. 2), a plural number of nozzle holes 21*a* is bored, aligned in the length direction thereof (that is, perpendicular to the plane of the paper).

When the article being treated 7 (shaded with dots to facilitate reading the drawing) passes between the main roll 1 and the suction roll 15*a*, a compressed air flow (arrow j) is blown between the article being treated 7 and the main roll 1, and the leading end 7*c* of that article being treated 7 is blown away from the main roll 1 as indicated by the hypothetical line. The leading end 7*c* of the article being treated so blown away is sucked onto the suction roll 15*a* by the in-sucking air flow (arrow s) of that suction roll 15*a*, rides on the guide belt 15*d*, is fed along toward the main roll 2 as indicated by the arrow e, is guided to the guide plate 15*g*, and is fed in between the main roll 2 and the heating bed 2*a*.

In the air jet pipe 21 in this example (see FIG. 3), multiple nozzle holes 21*a* are bored, aligned in the long direction thereof. In this example, a steel tube having a diameter of 42.7 millimeters, a thickness of 3.6 millimeters, and a length of 3160 millimeters is deployed parallel to the main roll 1, and 31 cut-out holes each having a diameter of 2 millimeters are formed at equal intervals to constitute the nozzle holes.

Figure 3:
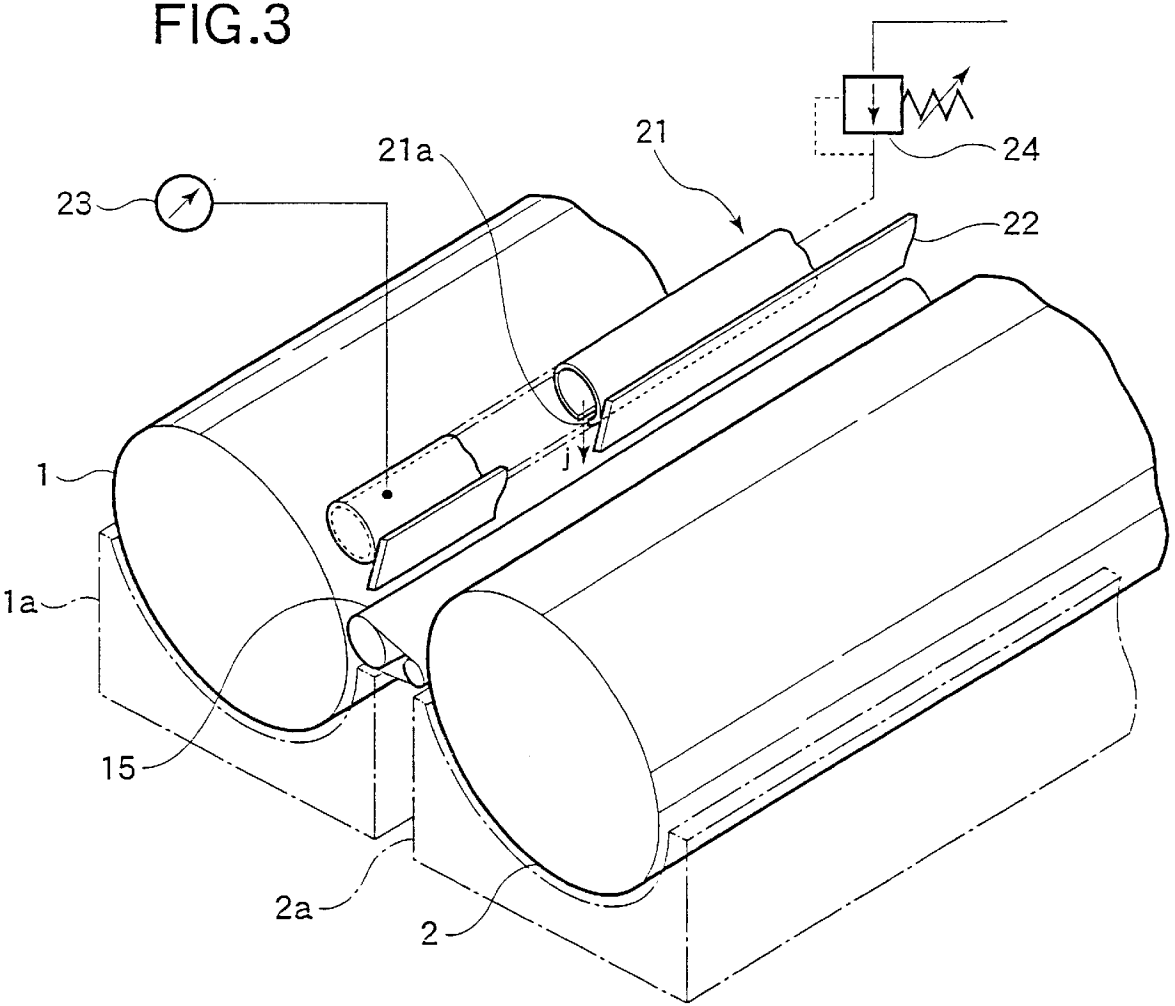
FIG. 3 is a perspective view wherein part of the roll finisher of the embodiment diagrammed in FIG. 1 cited above is cut out and depicted schematically.
Figure 4:
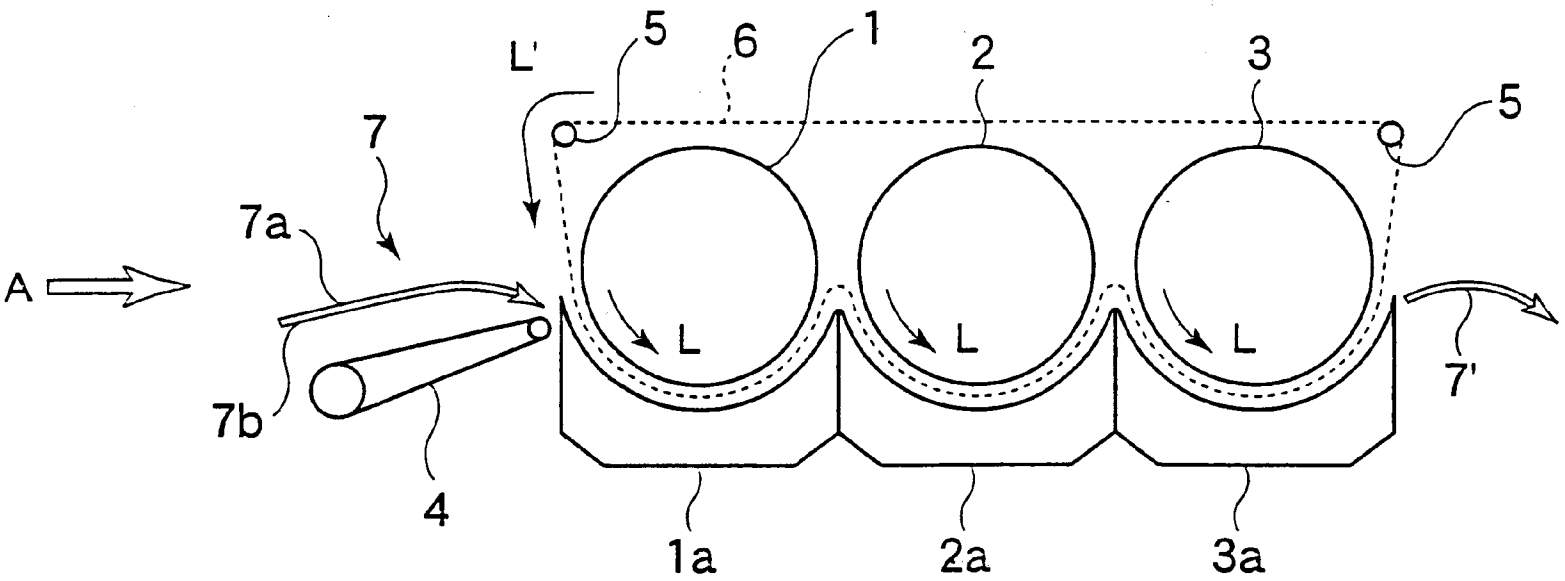
FIG. 4 is a side view showing a conventional example of a roll finisher that comprises a plurality of main rolls and heating beds, and ribbon tapes.
Figure 5:
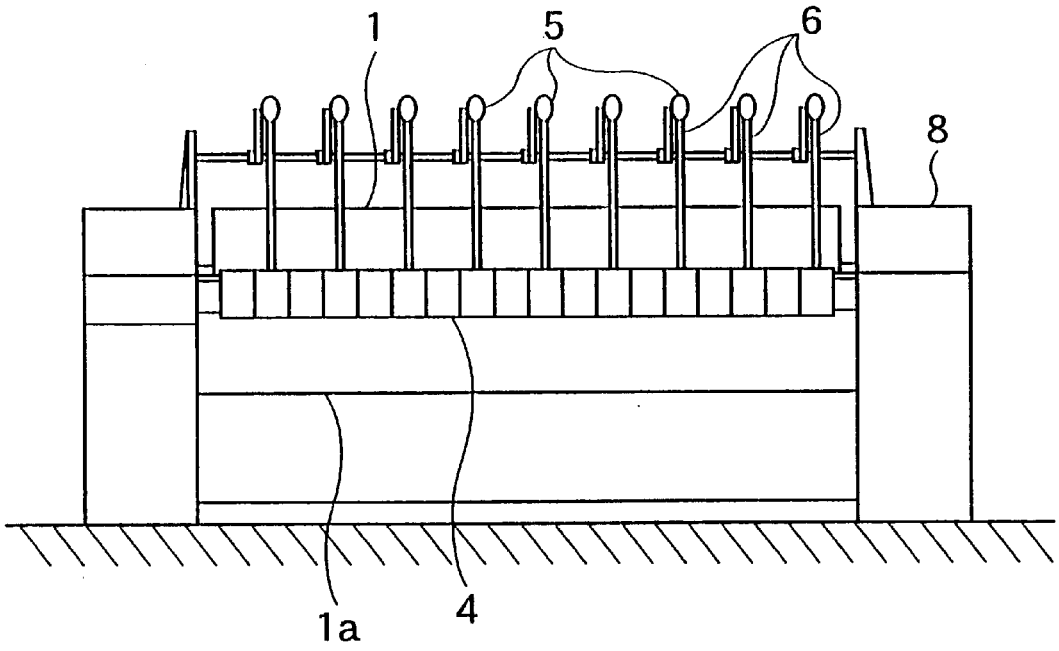
FIG. 5 is external view of the "roll finisher comprising ribbon tapes" diagrammed in FIG. 4 above, as seen from direction A as indicated in FIG. 4.
Figure 6:
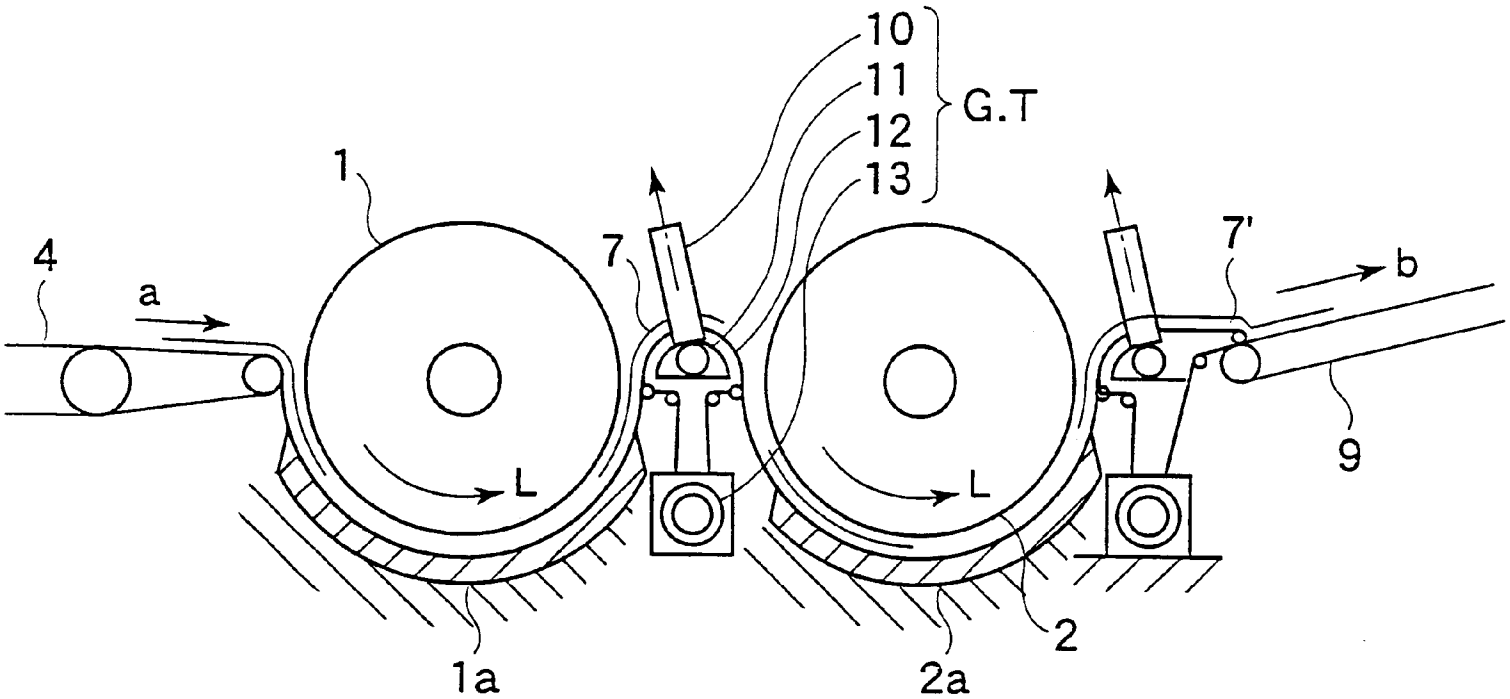
FIG. 6 is a side-view diagram of a publicly known roll finisher constituted such that the ribbon tapes indicated in FIGS. 4 and 5 cited above are omitted.
Figure 7:
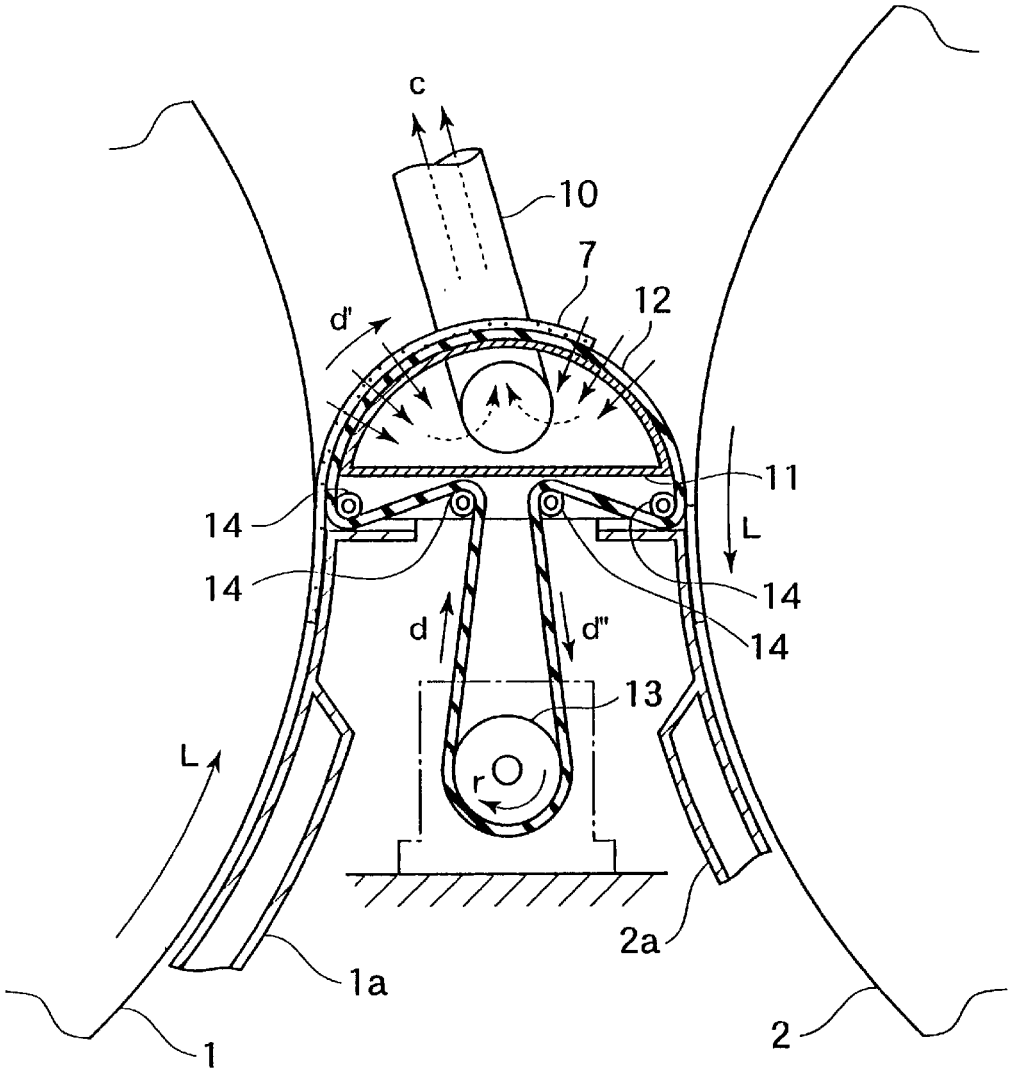
FIG. 7 is an enlarged cross-sectional diagram wherein the main parts of the publicly known roll finisher diagrammed in FIG. 6 above are extracted and depicted.
Figure 8:
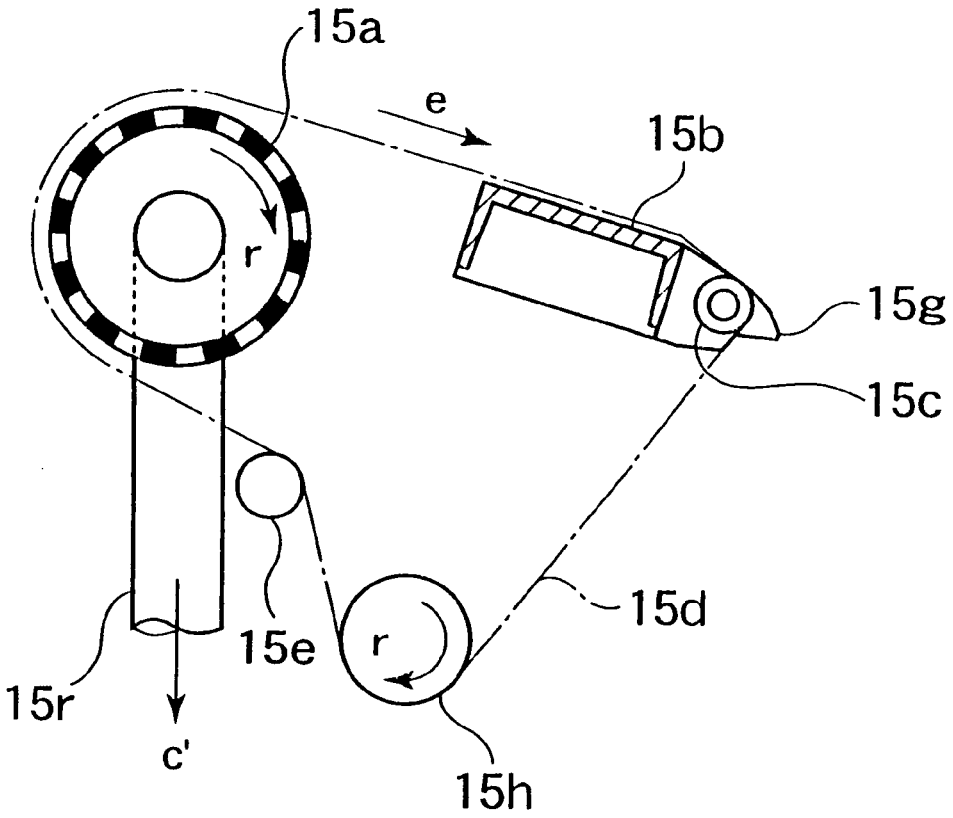
FIG. 8 is a cross-sectional diagram of the delivery mechanism portion of a publicly known roll finisher wherein the known roll finisher diagrammed in FIGS. 6 and 7 above has been improved so that the durable life of the guide belt is extended.

In FIG. 3, the air jet pipe 21 and air guiding plate 22 are drawn larger than actual, but the actual dimensions are as described above.

In embodying the present invention, the configurational members functioning as nozzles for jetting the air need not necessarily be cut-out holes; they may be narrow pipes or they may be slits.

In this embodiment, a steel plate having a length of 3048 millimeters, a width of 70 millimeters, and a thickness of 2 millimeters is welded to the air jet pipe 21, and the edge at the leading end thereof (length=3048 millimeters) is subjected to string beveling to configure the air guiding plate 22. In embodying the present invention, the air guiding plate does not necessarily have to be a flat plate.

The air jet pipe 21 noted above is connected via a pressure control valve 24 to a pressurized air source (not shown), and a manometer 23 is also connected.

As described earlier with reference to FIG. 2, the leading end 7*c* of the article being treated that is tightly attached to the main roll 1 is blown away by the jetting air flow (arrow j). According to the research and experiments performed by the present inventor, that jetting air flow should be neither too strong nor too weak.

The proper strength of the jetting air flow will differ depending on many factors, such as the texture and thickness of and level of starch in the article being treated, the shape, dimensions, and number of the nozzle holes 21*a*, and the shape and dimensions of the air guiding plate, but the most important factor is air pressure.

When the pressure control valve 24 is adjusted and the needle indication on the manometer 23 is set at less than 5 KPa, no matter how the other parameters are changed, the jetting air flow will be too weak, giving rise to a danger that the article being treated will not be transferred to the delivery mechanism 15 or that the article being treated will catch on the air jet pipe or the air guiding plate.

When the needle indication on the manometer 23 exceeds 15 KPa, on the other hand, there is a danger that wrinkles will develop in the leading end 7*c* of the article being treated 7, causing a deterioration in the roll finishing quality.

If the air pressure is from 9 to 13 KPa, even if no careful attention is given to conditions other than air pressure, more or less good operating conditions will be effected and the roll finishing quality will be good.

Instead of compressed air, moreover, some gas other than air (nitrogen, for example) can be blown.

The main role of the air guiding plate 22 is to effectively guide the air flow jetted as indicated by the arrow j from the nozzle holes 21*a* (see FIG. 2) so as to be aimed "between the main roll 1 and the leading end 7*c* of the article being treated 7," but a secondary benefit is afforded thereby, namely that therewith there is no danger of the article being treated that is riding on the guide belt 15*d* of the delivery mechanism being blown out of position by the jetting air flow.

Industrial Applicability

The present invention is useful for conveying an article being treated without human intervention in a roll finisher used in facilities for press-finishing cloth articles being treated, comprising main rolls and heating beds. More specifically, the action of the article being treated, that has been fed out from between a main roll and a heating bed, to move over to a conveying delivery mechanism is automatically aided, and the action can be effected without fail.

What is claimed is:

1. A roll finishing method for a cloth article being fed out from a roll finisher, which includes a main roll, a porous delivery mechanism connected to a suction means and a heating bed, the method comprising the steps of:

feeding the article between the main roll and heating bed toward a gap between the main roll and the delivery mechanism; and transferring a leading end of the article, as the leading end of the article passes through the gap, from the main roll to the delivery mechanism, wherein, substantially at the time when leading end of said article passes through gap between said main roll and the delivery mechanism, blowing compressed gas toward the gap and between the main roll and the leading end of said article such that the leading end of said article is separated and blown away from the surface of said main roll toward the delivery mechanism and drawn by the suction through the porous delivery mechanism onto said delivery mechanism.

2. The roll finishing method according to claim 1, wherein the compressed gas is jetted from a multiplicity of nozzles which are positioned in substantial parallel alignment to a line formed between the main roll and the delivery mechanism.

3. The roll finishing method according to claim 2, wherein the flow of said compressed gas jetted from said nozzles is guided between said main roll and leading end of said article by an air guiding plate without blowing and moving the article that has been transferred to said delivery mechanism.

4. The roll finishing method according to claim 2, wherein the pressure of said compressed gas supplied to said nozzles is controlled so as to be no lower than 5 KPa and no higher than 15 KPa.

5. A roll finisher for a cloth article comprising:

a main roll, a heating bed; and a delivery mechanism opposing the main roll for receiving and conveying a cloth article fed out from the gap between said main roll and said heating bed, wherein the main roll and the heating bed cooperate to feed the cloth article toward a gap between the main roll and delivery mechanism, and wherein the roll finisher further comprises a means for blowing compressed gas toward the gap and toward a position at which the main roll and the delivery mechanism oppose each other so that the leading end of said article is separated and blown away from the surface of said main roll onto the delivery mechanism.

6. The roll finisher according to claim 5, wherein the means for blowing compressed gas comprises a tubular member having a plurality of nozzle holes extending parallel to a line between the opposed main roll and the delivery mechanism.

7. The roll finisher according to claim 6, wherein the means for blowing compressed gas further includes an elongated air guiding plate attached to said tubular member.

8. The roll finisher according to claim 6, wherein the means for blowing compressed gas further includes a means for supplying compressed gas to said tubular member having a plurality of nozzle holes and a pressure control valve for adjusting the gas pressure inside said tubular member.

9. The roll finisher according to claim of claim 5, wherein the delivery mechanism is a porous and is connected to a suction means for drawing suction such that, as the leading end of said article is blown away from the surface of said main roll, the leading end is drawn by the suction through the delivery mechanism onto said delivery mechanism.

* * * * *